United States Patent [19]

Wade et al.

[11] 4,343,070

[45] Aug. 10, 1982

[54] REMOVAL OF LINT FROM COTTONSEED

[75] Inventors: Clinton P. Wade, Jefferson; Stanley P. Rowland, New Orleans, both of La.

[73] Assignee: The United States of America as represented by the Secretary of Agriculture, Washington, D.C.

[21] Appl. No.: 180,542

[22] Filed: Aug. 25, 1980

[51] Int. Cl.[3] ..... D01B 1/04; F26B 19/00

[52] U.S. Cl. ..... 19/40; 47/58

[58] Field of Search ..... 19/40, 39, 41; 47/1 R, 47/58; 8/140

[56] References Cited

U.S. PATENT DOCUMENTS

| | | | |
|---|---|---|---|
| 4,064,636 | 12/1977 | Downing | 19/40 |
| 4,259,764 | 4/1981 | Downing | 47/58 X |
| 4,261,139 | 4/1981 | Pogue | 47/58 |

FOREIGN PATENT DOCUMENTS

| | | | |
|---|---|---|---|
| 418573 | 8/1974 | U.S.S.R. | 19/40 |
| 499348 | 4/1976 | U.S.S.R. | 19/40 |

OTHER PUBLICATIONS

The Cotton Fiber-Seed Bond: The Weakening Effects of Enzymes and Wetting Agents by C. P. Wade, S. P. Rowland; Transactions of the ASAE (vol. 22, No. 6, pp. 1458, 1459, 1460, 1461, 1462), published by the ASAE, St. Joseph, Mich., Nov.-Dec. 1979.

*Primary Examiner*—Louis Rimrodt

*Attorney, Agent, or Firm*—M. Howard Silverstein; David G. McConnell; Raymond C. Von Bodungen

[57] ABSTRACT

The removal of lint fibers from the cottonseed is facilitated by aqueous pretreatments of the cotton boll with dilute chemical substances. The wet processing of the boll renders the lint amenable to easy removal from the seedcoat in the wet or dry states.

8 Claims, No Drawings

REMOVAL OF LINT FROM COTTONSEED

BACKGROUND OF THE INVENTION (1) Field of the Invention

This invention relates to wet chemical processing of cotton prior to ginning. More specifically, this invention relates to instituting a wet chemical treatment to provide ease of removal of the lint from the cottonseed.

(2) Description of the Prior Art

OSHA Cotton Dust Standards as well as present and future problems with energy and byssinosis emphasize the need for new approaches to removal of lint from cottonseed. Studies on byssinosis have indicated that the active ingredient in cotton dust, which probably comes from the bract, is water soluble, filterable, nonvolatile at relatively high temperature, and nondialyzable. A water rinse of the ginned lint might solve the byssinosis-dust problem by reducing the dust and removing the active byssinosis ingredient from subsequent fiber and textile operations. Because OSHA recognizes this thoroughly washed cotton is exempt from the standards.

When cotton lint is removed from the seed, either by hand or commercial ginning, the point of breakage is at the epidermis, in the immediate vicinity of the elbow. The fiber base below the surface of the constricted region of the shank remains after the fiber is removed. The literature concludes that fibers of cultivated cottons are characterized by some type of weak place in the vicinity of the fiber elbow, and that the weak place is probably due to non-visible differences in wall structure.

It has also been reported that the moisture content of lint during ginning influences lint quality. The quality improves as moisture content is increased, subject to the limitation of wet fibers clogging the gin. It has also been pointed out that a wet gin produced a fiber distribution array with more longer fibers and fewer short (damaged) fibers than did the saw gin, thus significantly improving lint quality.

The Prior Art is thoroughly explored by C. P. Wade and S. P. Rowland, the present inventors, in their disclosure of the present invention in the paper "The Cotton Fiber-Seed Bond: the Weakening Effects of Enzymes and Wetting Agents", which appears in the TRANSACTIONS of the ASAE (Vol. 22, No. pp. 1458–1462) November–December 1979 issued which was mailed on Feb. 29, 1980.

SUMMARY OF THE INVENTION

The art of cotton-ginning is advanced by the process of the present invention in that the lint of cottonseed is rendered amenable to easier and more efficient removal from the seedcoat by subjecting the open cotton boll to an impregnation with an aqueous solution containing either a certain wetting agent or a certain enzyme, the latter preferably in combination with a wetting agent. The treatment while affecting the point of attachment of the lint to the seedcoat does not affect the strength of the fiber nor the strength of the products derived therefrom. To achieve full effect of the pretreatment, the cotton pretreated with wetting agent only should be ginned in the wet state, but the cotton pretreated with enzyme and wetting agent should be ginned in the wet or dry state.

DESCRIPTION OF THE PREFERRED EMBODIMENTS

Although the process of the present invention is relatively simple, certain parameters must be observed. Significantly, not all wetting agents would work, and very few enzymes provide the weakening of the fiber at the right place. The preferred wetting agents include a wide variety of commercially available solutions. They simply must be diluted to the preferred concentraation. The preferred concentration of the wetting agents is about from as low as 0.01% to as high as about 5%, depending on the particular agent employed. The readily available wetting agents include sodium alkyl sulfate examplified by sodium dodecyl sulfate; alkaryl polyether alcohol, exemplified by Triton X-100; sodium alkyl polyether sulfate, exemplified by Triton 770; trimethylnonyl polyethylene glycol ether, exemplified by Tergitol TMN; and sodium dioctyl sulfosuccinate, exemplified by Aeorosol OT. The enzymes include certain hemicellulases, specifically xylanase from the *Aspergillus niger* Series.

With reference to applicable temperatures, a range of about from 20° to 70° C. was found suitable, but the preferred figure was 50° C., in a solution having a pH of as low as 3 and as high as 7, but a preferred pH near 4. The time allowed for the fibers to respond to the treatment of the present process has been as low as 15 minutes and as high as 120 minutes.

The following examples are provided to illustrate certain aspects of the present invention and are not meant to limit the invention in any manner whatsoever.

EXAMPLE 1

To Illustrate Certain Negative Aspects to Avoid

When single cottonseeds were placed in cellulase solution (1 ml/10 mg of seed) and shaken for various periods, action of the enzymes was evidenced by weakening of the fiber-seed bond, separation of the lint from the seed, and degradation of the lint into small fiber segments. After 30 minutes of impregnation of the cotton at 50° C. the strength of the fiber-seed bond was reduced to the point where the lint was easily separated from the seed. After 60 minutes of this treatment, fiber degradation occurred throughout the entire length of the fiber. Investigation showed also that there were differences more so between bolls than within bolls. From this investigative work it was determined that time limits must be observed lest an excessive degradation of the lint be initiated. It was also noted that while some enzymes do not attack the cotton there are others which completely convert the cellulose to glucose, such as for example the cellulase from *T. viride.*

With reference to the treatments with wetting agents, the several series of investigative experiments indicated that a solution containing a wetting agent wherein the pH of the solution was above 5 the seed bonds were not weakened as much as desired. Therefore, it is desirable that pH be maintained near 4 or slightly below.

EXAMPLE 2

To Illustrate the Use of a Suitable Enzyme

A series of experiments was planned to observe the effects of enzymatic action on the seed bond, that is the strength of the point of attachment of the lint to the seedcoat of cottonseed.

The quantity of enzyme in the solution was varied, the temperature of the solution was varied, and the pH was varied. The degree of strength at the point of attachment was determined subjectively, and a more scientific approach to this measurement is being prepared for future studies. The pulling action was applied by hand both to the wet material and to the dry material. A test, for example, which would indicate that the fiber-seed bond was "strong" should tell the reader that the enzymatic action was ineffective. The extreme opposite would be recorded as "weak". This would indicate that enzymatic action was as desired, that is, the seed bond would be weakened; however, further investigation would be required once a "weak" determination was found, since it was desirable to weaken only the point of attachment of the lint to the seedcoat, not the weakening of the entire fiber.

A tabulation of the significant data is presented below for a rapid view of the data obtained from the investigative work. A more complete study would be available in the cited paper by these authors. (See Table I)

TABLE I

PECTINASE AND HEMICELLULASE ACTIVITY ON FIBER-SEED BOND*

| Enzyme (amt, mg) | Temperature, °C. | pH of treatment | Fiber-seed bond Wet | Fiber-seed bond Dry |
|---|---|---|---|---|
| | | PECTINASE | | |
| 100 | 40 | 3.5 | moderately strong | strong |
| 500 | 40 | 3.5 | weak | moderately strong |
| 500 | 50 | 4.0 | weak | moderately strong |
| | | HEMICELLULASE FROM RHIZOPUS MOLD | | |
| 100 | 60 | 5.5 | strong | strong |
| 500 | 60 | 5,5 | strong | strong |
| | | HEMICELLULASE (XYLANASE) FROM *A. niger* | | |
| 100 | 50 | 4.2 | strong | moderately weak |
| 200 | 50 | 4.2 | weak | moderately weak |
| 500 | 50 | 4.2 | weak | moderately weak |
| 200 | 25++ | 4.2 | moderately weak | very weak |
| 200 | 50 | 4.2 | weak | very weak |

*Conditions of treatment: 20 ml of solution was used per seed (0.05 M citric acid-sodium citrate buffer, pH 4.2: or 0.05 M citric acid-sodium dihydrogen phosphate buffer, pH 5.5 with 0.1 percent Tergitol TMN); filtered to remove undissolved solids prior to use: treated 120 min. without agitation. Conditions (temperature and pH) employed for the enzymes are those recommended for assay by the suppliers.

+ This treatment was conducted for 16 h.

The buffer molarity was reduced from 0.05 to 0.0125 in this solution.

EXAMPLE 3

To Illustrate the Effect of Certain Wetting Agents on the Fiber-Seed Bond

A series of aqueous dilute solutions were prepared for wet-impregnation studies of cottonseeds with some selected wetting agents. Each solution was of a 0.1% concentration, and each solution was made up with 0.05 M pH 4.3 citric acid-sodium citrate buffer.

A single cottonseed boll was pulled apart so as to remove all the seeds and subject seeds from a single boll to this series of treatments. Each seed was immersed and retained immersed in a separate solution, without agitation, for a period of 120 minutes at a temperature of 50°. The wetting agents were as indicated in the table (Table II) mostly commercially available wetting agents.

For identification purposes it must be pointed out that the Triton X-100 is an alkylaryl polyether alcohol, the Triton 770 is a sodium alkyl polyether sulfate, the Tergitol TMN is a trimethylnonyl polyether alcohol, and the Aerosol OT is sodium dioctyl sulfosuccinate. Note also that the sodium dodecyl sulfate can be either satisfactory or otherwise for this particular application, depending on the concentration.

TABLE II

EFFECTS OF VARIOUS WETTING AGENTS ON FIBER-SEED BOND*

| Treating Solution | Fiber-seed bond |
|---|---|
| Water only | strong |
| Triton X-100 | moderately strong |
| Triton 770 | moderately weak |
| Aerosol OT | moderately weak |
| Tergitol TMN | weak |
| Sodium dodecyl sulfate | weak |
| Tergitol TMN, 0.05 percent | moderately weak |
| Sodium dodecyl sulfate, 1.0 percent | strong |

We claim:

1. A process for the improvement of cotton-ginning by chemical treatment to render lint ameanable to easy removal from cottonseed without affecting the strength of the fiber or the fabric made therefrom, the process comprising:
   (a) impregnating the open cotton boll with an aqueous solution containing one or more compounds selected from the group consisting of:
   a certain wetting agent, and
   a hemicellulase from the Aspergillus niger Series,
   (b) allowing time for the point of attachment of the lint to the seedcoat to respond to the action of the wetting agent or the action of the enzyme, and
   (c) subjecting the wet cotton boll to the ginning process.

2. The process of claim 1 wherein the wetting agent is selected from the group consisting of
   sodium dodecyl sulfate,
   an alkylaryl polyether alcohol (Triton X-100),
   a sodium alkylaryl polyether sulfate (Triton 770),
   trimethylnonyl polyethylene glycol ether (Tergitol TMN-10),
   and
   sodium dioctyl sulfosuccinate (Aerosol OT).

3. The process of claim 1 wherein the enzyme is xylanase.

4. The process of claim 1 wherein the temperature of the impregnating solution is about from 20° to 70° C.

5. The process of claim 1 wherein the pH of the impregnating solution is about from 3 to 7.

6. The process of claim 1 wherein the concentration of the impregnating solution is about from 0.01% to 5%.

7. The process of claim 1 wherein the time allowed for response to enzymatic action is about from 15 to 120 minutes.

8. The process of claim 1 wherein the time allowed for response to wetting action is about from 15 to 120 minutes.

* * * * *